US011110570B2

(12) United States Patent
Douglass

(10) Patent No.: US 11,110,570 B2
(45) Date of Patent: Sep. 7, 2021

(54) REVERSIBLE ROLLER WRENCH WITH A SCALLOPED OUTER RACE

(71) Applicant: Earl Stuart Douglass, Auburn, CA (US)

(72) Inventor: Earl Stuart Douglass, Auburn, CA (US)

( * ) Notice: Subject to any disclaimer, the term of this patent is extended or adjusted under 35 U.S.C. 154(b) by 473 days.

(21) Appl. No.: 14/989,641

(22) Filed: Jan. 6, 2016

(65) Prior Publication Data

US 2016/0193721 A1 Jul. 7, 2016

Related U.S. Application Data

(60) Provisional application No. 62/100,358, filed on Jan. 6, 2015.

(51) Int. Cl.
*B25B 13/46* (2006.01)

(52) U.S. Cl.
CPC ..... *B25B 13/462* (2013.01)

(58) Field of Classification Search
CPC ... B25B 13/462; B25B 13/463; F16D 41/086; F16D 41/088; F16D 41/067; F16C 33/46; F16C 33/467
See application file for complete search history.

(56) References Cited

U.S. PATENT DOCUMENTS 2,583,544 A * 1/1952 Burdick ..... B25B 13/462 192/44
2,584,256 A * 2/1952 Brown ..... B25B 13/462 192/44
4,873,898 A * 10/1989 Chern ..... B25B 13/462 81/59.1
5,499,559 A * 3/1996 Lin ..... B25B 13/462 192/44
6,044,944 A * 4/2000 Adams ..... B25B 13/462 192/43
6,055,888 A * 5/2000 Mitchell ..... B25B 13/462 81/59.1
6,276,239 B1 8/2001 Albertson
8,613,350 B2 * 12/2013 Nease, III ..... F16D 41/088 192/44
8,904,907 B2 * 12/2014 Douglass ..... B25B 13/46 81/59.1
2004/0007097 A1 * 1/2004 Matsumoto ..... B25B 13/462 81/59.1
2004/0007437 A1 * 1/2004 Linzell ..... B25B 13/44 192/38
2007/0245857 A1 * 10/2007 Phillips ..... B25B 13/461 81/59.1

FOREIGN PATENT DOCUMENTS

JP 2004011667 A * 1/2004 ..... F16C 33/467

* cited by examiner

*Primary Examiner* — Bryan R Muller
(74) *Attorney, Agent, or Firm* — Jeffrey T. Holman; Ross N. Crandall

(57) ABSTRACT

A torque transfer device includes a handle, a roller cage bias ring, a plurality of rollers and a spindle. The handle includes a scalloped outer race. The roller cage bias ring is located within the scalloped outer race. The roller cage bias ring includes a base ring and a plurality of pillars extending out of the base ring. The rollers are positioned between the pillars. The spindle includes a circular inner race.

25 Claims, 10 Drawing Sheets

REVERSIBLE ROLLER WRENCH WITH A SCALLOPED OUTER RACE

CROSS-REFERENCE TO RELATED APPLICATIONS

This application claims the benefit of U.S. Provisional Patent Application Ser. No. 62/100,358 filed on Jan. 6, 2015, and entitled "Reversible Roller Wrench with a Scalloped Outer Race," the contents of which are hereby incorporated by reference herein.

BACKGROUND

Conventional designs for reversible torque wrenches suffer from design defects that result in various failures and inconveniences to a user. Many typical reversible torque wrenches are designed for two hand manipulation of reversing mechanisms. Conventional designs also result in off-axis locking and auto reverse. Embodiments described herein eliminate off-axis locking and auto reverse and allow single hand manipulation of reversing mechanisms.

SUMMARY

Embodiments of a torque transfer device are described. In one embodiment, a torque transfer device includes a handle, a roller cage bias ring, a plurality of rollers and a spindle. The handle includes a scalloped outer race. The roller cage bias ring is located within the scalloped outer race. The roller cage bias ring includes a base ring and a plurality of pillars extending out of the base ring. The rollers are positioned between the pillars. The spindle includes a circular inner race. Other embodiments of a torque transfer device are described.

Other aspects and advantages of embodiments of the present invention will become apparent from the following detailed description, taken in conjunction with the accompanying drawings illustrated by way of example of the principles of the invention.

Figure 1A:
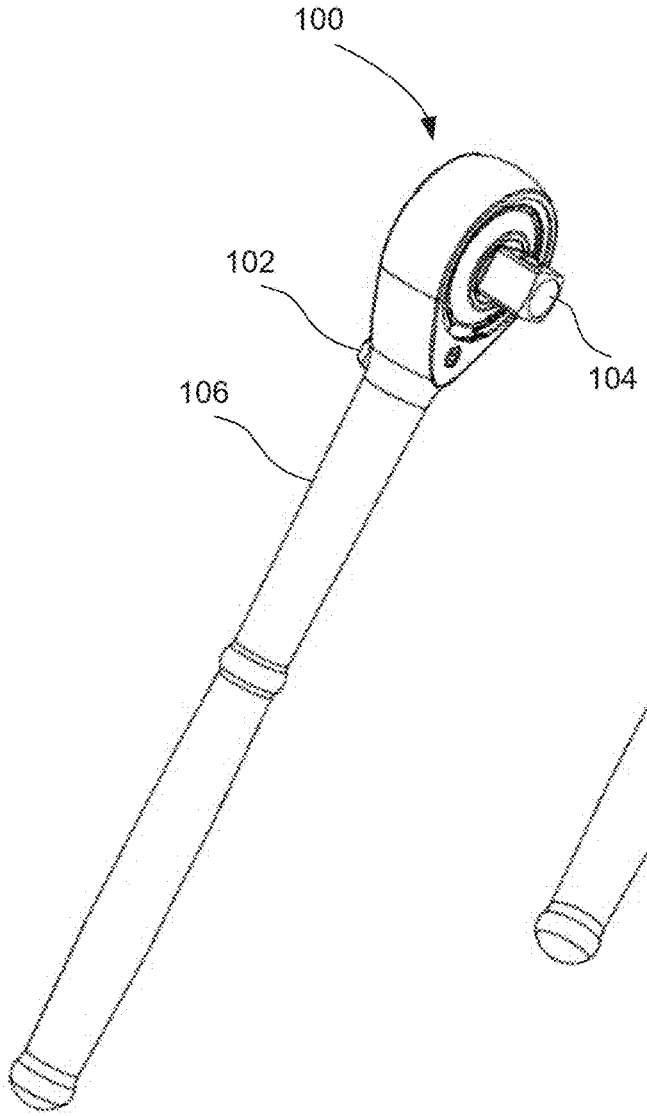
FIG. 1A depicts a perspective front view of an embodiment of a torque transfer device.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

It will be readily understood that the components of the embodiments as generally described herein and illustrated could be arranged and designed in a wide variety of different configurations. Thus, the following description of various embodiments, and as represented in the figures, is not intended to limit the scope of the present disclosure, but is merely representative of various embodiments.

The present invention may be embodied in other specific forms without departing from its spirit or essential characteristics. The described embodiments are to be considered in all respects only as illustrative and not restrictive. All changes which come within the meaning and range of equivalency of the description and claims are to be embraced within their scope.

Reference throughout to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some of the described embodiments relate generally to a reversible torque transfer device. This clutch design may be used in many different applications. The example used for the illustrative purposes of this patent is a socket wrench.

The industry standard for indexing wrenches include a "roundhead" or a "pearhead", where the roundhead has a circular head shape and the pearhead has an elongated head shape. The individual shape is derived from the geometry of the interior gears and reverse mechanism. In general, the roundhead reverse switch requires both hands to engage while the pearhead reverse switch will engage with a single hand.

For the class of wrenches that employ a reversible roller clutch to transfer torque from the wrench to the fastener, existing designs are configured with a smooth outer race, a ramped inner race, and the roundhead shape. Each of these designs utilizes a reverse switch which is located in the center of the wrench head and requires the operator to apply both hands to the handle in order to shift from forward into reverse or vice versa. A functional roundhead design with a reversing mechanism for the inner race has been previously disclosed by Douglass (U.S. Pat. No. 8,904,907). The current specification discloses embodiments of a reversible roller clutch configured with a smooth inner race, a ramped or scalloped outer race, and a pearhead shape. In addition, embodiments include a reversing mechanism which enables the operator to shift directions using only a single hand.

Several inventors including Mitchell (U.S. Pat. No. 6,055,888) and Albertson (U.S. Pat. No. 6,276,239) have previously disclosed reversible roller clutch designs which fall under the roundhead category. Unfortunately each of these designs suffers from a variety of engineering flaws including off-axis locking, brinelling, and auto reverse. These inherent defects have rendered them impractical in the real world and have led to costly recalls from the marketplace. In addition, the designs require the operator to remove the device from the working surface and apply both hands to engage the reverse switch. Both of these actions are time consuming and defeat the purpose of the original ratcheting wrench.

Some embodiments of the present disclosure illustrate a ramped or scalloped outer race in combination with an efficient cage assembly including a roller cage bias ring and rollers to eliminate or greatly reduce off-axis locking and auto reverse. Locating the ramps or scallops on the outer race eliminates or greatly reduces the possibility of off-axis locking (OAL) and auto reverse. Off-axis locking occurs in conventional designs when the operator applies a force to the handle while the handle is not parallel to the working surface. Off-axis stress allows the spindle to fall out of alignment with the head and to locate itself in an off-axis position. The angle of the spindle releases the contact on one or two rollers which will automatically seek the path of least resistance and slide onto the opposite side of the ramp. At that point the spindle will lock in both directions with some of the rollers holding the forward position and the balance holding the reverse position. The tool is now in failure mode and inoperable. Off-axis locking occurs with conventional inner race designs. The reason for such a failure is the relationship between the rollers and the spindle. The inner race requires the spindle and the rollers to rotate together within the housing. Each roller is mated to one ramp and both of them turn simultaneously. The spindle and rollers float within the head until the operator applies a force to the handle. This force compresses the rollers between the ramps and the housing. If the compressive force is uneven as is the case with OAL then a number of the rollers will roll out of position and lock the spindle in either direction. Embodiments disclosed herein eliminate or greatly reduce off-axis locking. Embodiments disclosed herein (with an outer race configuration) function in the opposite manner. The ramps are attached to the head or handle and do not rotate with the spindle. In some embodiments, each roller is mated with one ramp of a scallop and is also stationary as only the spindle rotates. This lack of freedom confines the rollers and eliminates their ability to move out of position. Therefore a solution to OAL is found in embodiments disclosed herein with an outer race configuration.

Some embodiments include a roller cage bias ring. One of the purposes of the roller cage bias ring is to simultaneously locate each of the rollers in their correct position between the spindle and the scalloped outer race. Once this position has been achieved it becomes possible to lock the spindle in place and apply a tremendous amount of torque to the socket and fastener. More importantly, the cage assembly will eliminate brinelling and roller slip.

Some embodiments include a cage assembly comprising of a base ring and a top ring. Each ring has pillars (spacing elements or fingers) attached that are designed to position the individual rollers within their assigned scallop. In some embodiments, the base ring is rotated by a reverse lever and simultaneously urges each roller into position. In some embodiments, the reverse lever is located at the intersection between a handle and a wrench head. In some embodiments, the wrench head is integral to the handle and do not move relative to each other. In some embodiments, elongating the head to accept a reverse lever or switch gives the tool the "pearhead" shape.

In some embodiments, the cage assembly is designed to apply a consistent urging effect to the rollers. This urging effect enables the rollers to move out of a neutral position relative to the scalloped outer race and to start climbing the scalloped ramps. Each of these rollers must maintain an identical location on their individual ramp and remain parallel to the drive spindle. This simultaneous engagement is provided by disclosed embodiments.

In some embodiments, the reverse lever which is operated with a single hand and rotates a cage assembly or roller cage bias ring placed between a scalloped outer race and a spindle with a smooth inner race. Embodiments disclosed herein are faster, ergonomic, and more efficient than the two handed switch designs currently available with roller clutches. This benefit enables an operator to rapidly change from forward to reverse without the delayed effect created by removing both hands from the work area.

In addition, some embodiments designed to eliminate auto reversal of a spindle. In conventional designs (inner race configurations), sudden reversal of the spindle may occur at high torque levels. Such design defects are a result of the geometry of conventional race ramps, the mobility of the rollers, and a lack of sufficient contact surface. The spindle utilizes a hertzian contact stress to stabilize the rollers. This contact stress may be overpowered with a sufficient torque load. At that point the rollers move to the opposite side of the ramp with a sudden loss of torque. This is a dangerous reaction in the event an operator impacts his hands on a solid surface such as an engine or fan blade. Sudden reversal of this type is eliminated with the outer race design and embodiments disclosed herein. The individual rollers are locked into place with the scallops and do not rotate with the spindle. In addition, the scallops provide the correct amount of contact surface area needed to maintain the load. The combination of the race geometry and the confined rollers is a solution to the sudden reverse of conventional designs.

It is important that sufficient contact surface area exists between the rollers, the spindle and the housing as illustrated in U.S. Pat. No. 6,044,944 by Adams and hereby incorporated into this specification. The present disclosure illustrates the concave scalloped shape of the outer race mated with the convex face of the rollers. This is a geometry for maintaining a minimum contact surface area required to achieve maximum torque and to eliminate brinelling.

Embodiments disclosed herein are improvements over existing roller clutch designs and enables devices to be stronger, safer and easier to operate.

FIG. 1A depicts a perspective front view of an embodiment of a torque transfer device 100. The illustrated embodiment depicts a reversible roller wrench with a scalloped outer race (internal, not shown). Although the torque transfer device 100 is shown and described with certain components and functionality, other embodiments of the torque transfer device 100 may include fewer or more components to implement less or more functionality.

The illustrated embodiment includes a reverse lever 102, a spindle 104 including a circular inner race (internal, not shown), and a handle 106 including a pearhead shaped head portion. In the illustrated embodiment, the reverse lever 102 includes two positions. A first position of the reverse lever 102 allows the spindle 104 to rotate relative to the handle 106 in one of a clockwise or a counter-clockwise direction and restricts rotation of the spindle 104 relative to the handle 106 in the opposite. A second position of the reverse lever 102 will reverse the allowed rotational direction and restricted rotational direction of the spindle 104 relative to the handle. In the illustrated embodiment, the spindle 104 is configured to attach to various attachments or sockets and drive rotation of the attachments or sockets.

Figure 1B:
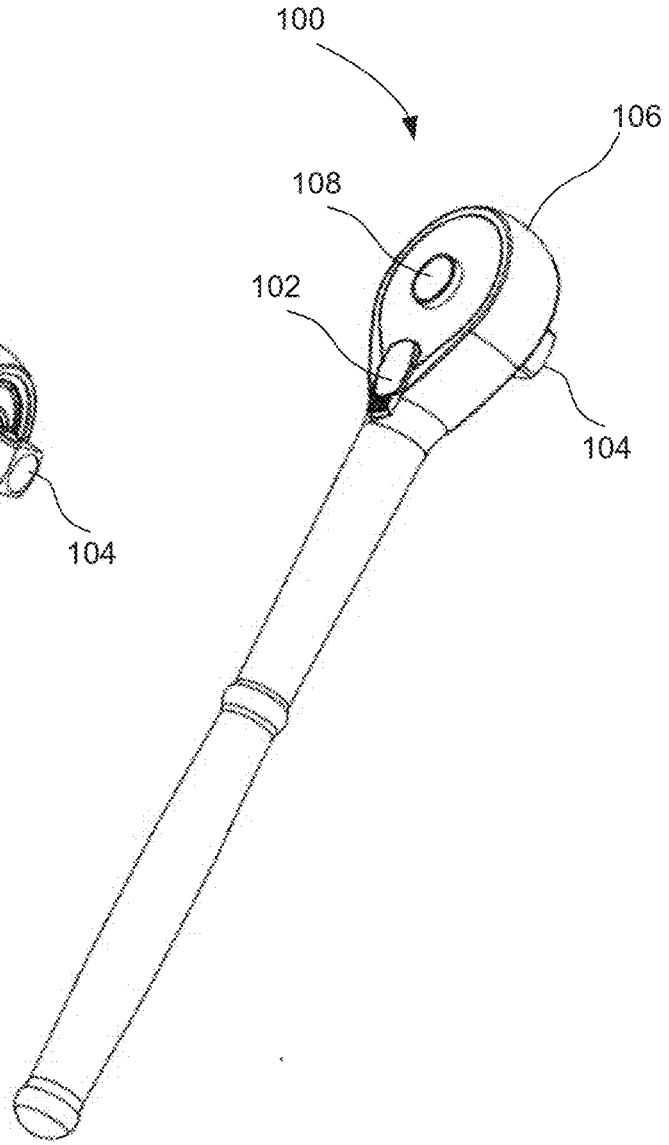
FIG. 1B depicts a perspective rear view of the torque transfer device of FIG. 1A.

FIG. 1B depicts a perspective rear view of the torque transfer device 100 of FIG. 1A. The illustrated embodiment depicts the reverse lever 102, the spindle 104 including a circular inner race (internal, not shown), the handle 106 including a pearhead shaped head portion, and a quick release plunger 108. In the illustrated embodiment, the reverse lever 102 is shown in a first position which allows the spindle 104 to rotate relative to the handle 106 in one of a clockwise or a counter-clockwise direction and restricts rotation of the spindle 104 relative to the handle 106 in the opposite. As can be seen by the illustrated embodiment, a user can engage the reverse lever 102 with the same hand that holds the handle 106 without releasing the handle 106. For example, the hand of the user may grip the handle 106 and engage the reverse lever 102 with the thumb of the same hand. This allows a user reverse the allowed and restricted rotation with the use of a single hand. Existing designs require an operator to apply both hands to the handle in order to reverse rotational direction. In some embodiments, the reverse lever 102 is located outside the outer race of the torque transfer device 100. In typical designs, the switch or lever of the reverse mechanism is located on the center of the head.

Embodiments of a single hand reverse lever 102 are safer to engage than a two handed design. This is helpful for an operator working at the top of a ladder or an elevated platform as it allows for one hand to work the wrench and the other hand to hold on for balance.

The illustrated embodiment depicts a quick release plunger 108 that in some embodiments may be depressed and will release the socket or attachment attached to the spindle.

Figure 1C:
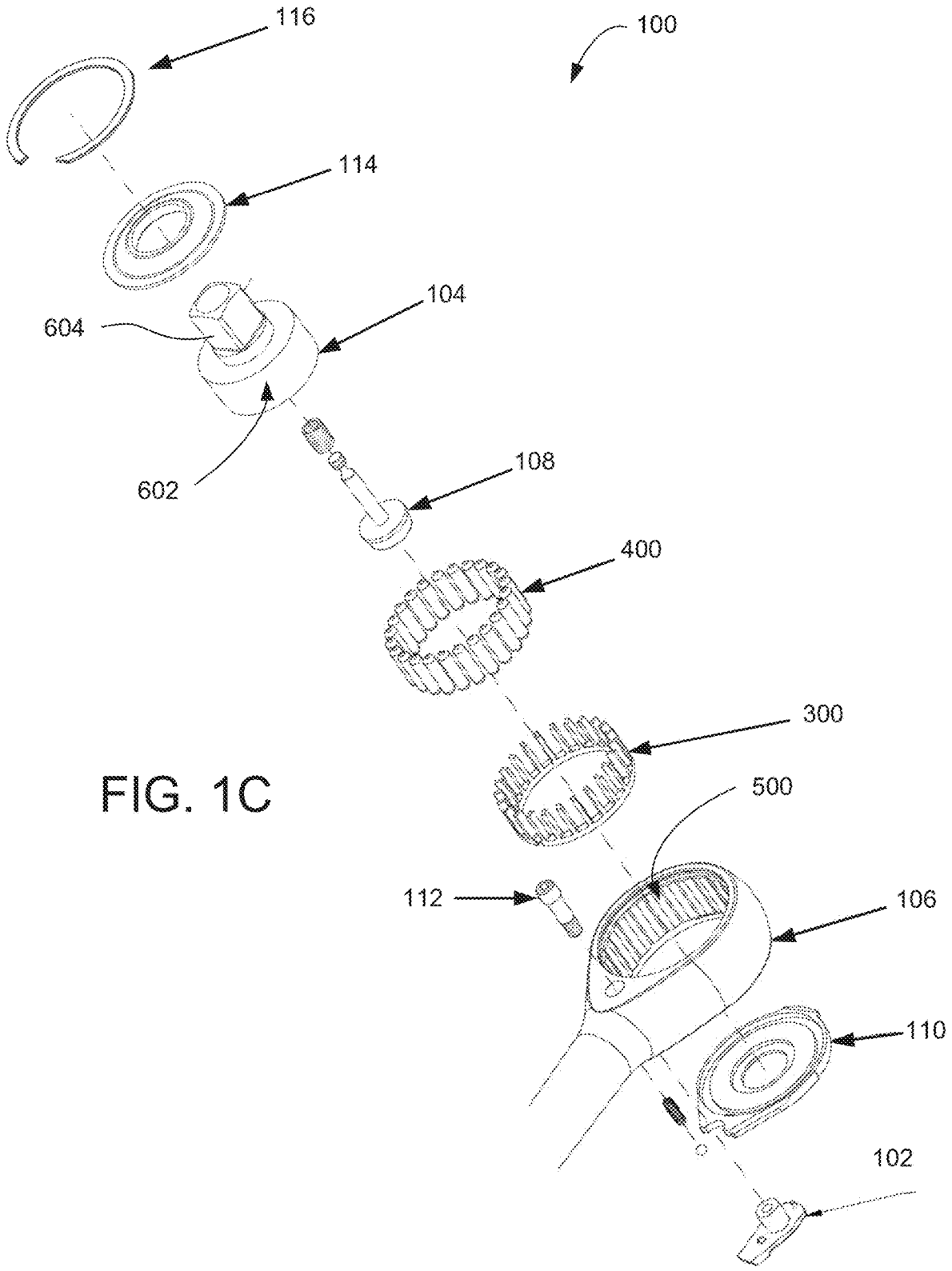
FIG. 1C depicts an exploded perspective front view of the torque transfer device of FIGS. 1A and 1B.
Figure 1D:
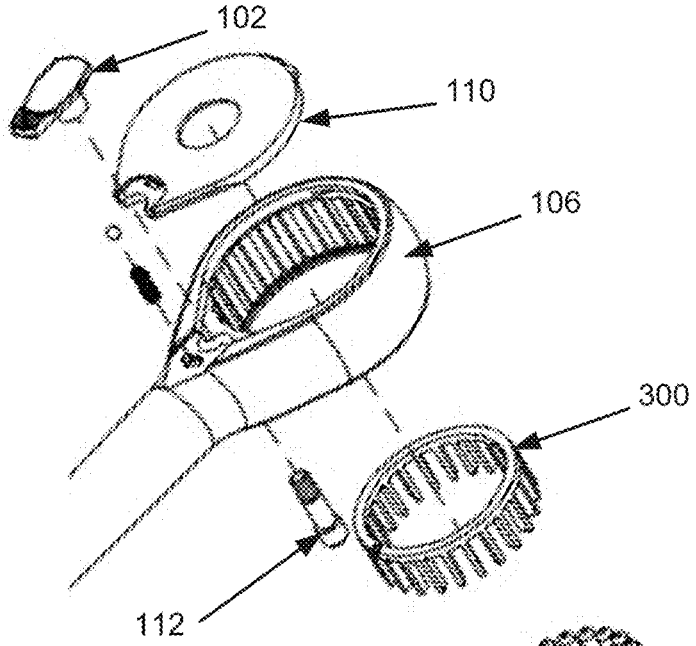
FIG. 1D depicts an exploded perspective rear view of the torque transfer device of FIGS. 1A and 1B.
Figure 1E:
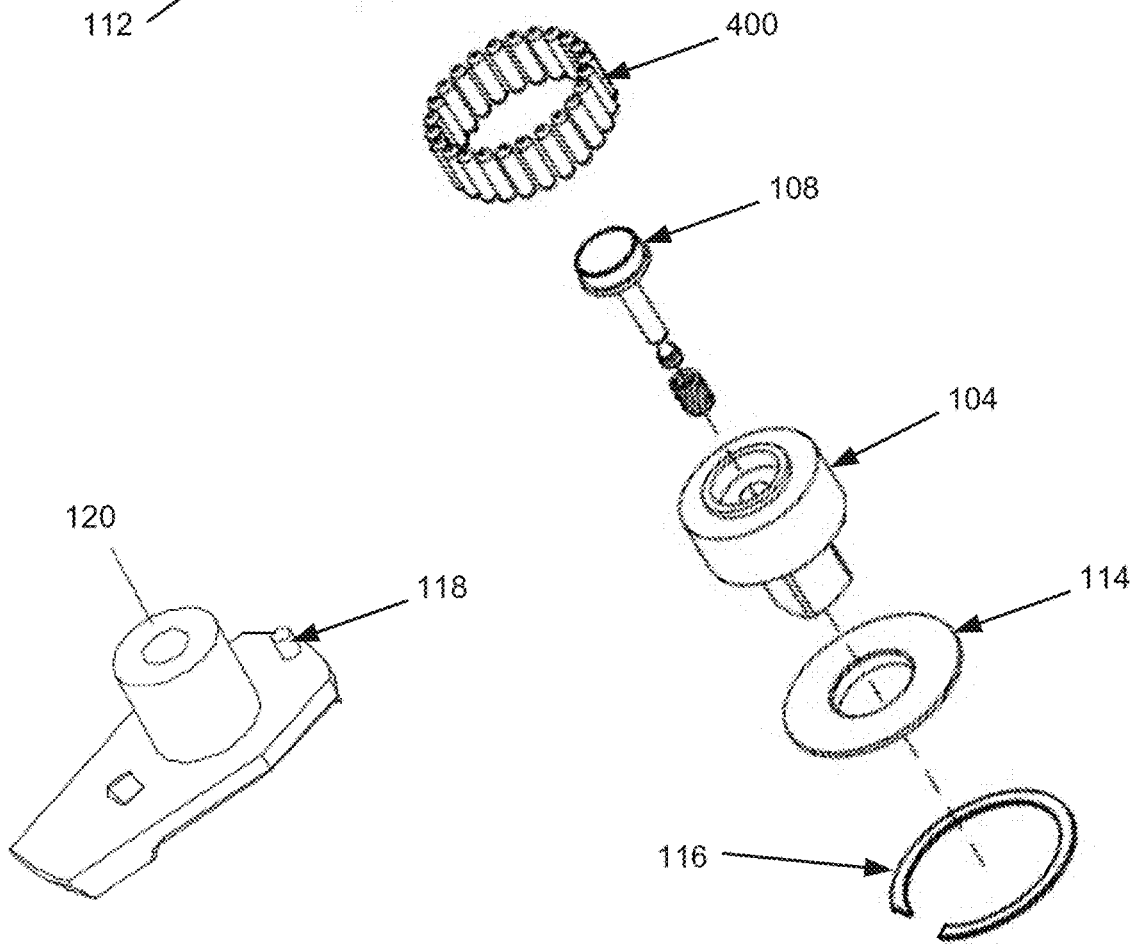
FIG. 1E depicts a larger view of the reverse lever 102.

FIG. 1C depicts an exploded perspective front view of the torque transfer device 100 of FIGS. 1A and 1B including the scalloped outer race. The illustrated torque transfer device includes a reverse lever 102 and associated spring, a backplate 110, a handle 106 including the scalloped outer race 500, a shoulder screw 112, a roller cage bias ring 300, a plurality of rollers 400, a quick release plunger 108 and associated spring, spindle 104, front cap 114, and snap ring 116. Although the torque transfer device 100 is shown and described with certain components and functionality, other embodiments of the torque transfer device 100 may include fewer or more components to implement less or more functionality. FIG. 1D depicts an exploded perspective rear view of the torque transfer device of FIGS. 1A and 1B. FIG. 1E depicts a larger front view of the reverse lever 102 of FIG. 1C.

In the illustrated embodiment, the handle 106 includes a head portion including the scalloped outer race 500. In some embodiments, the head and handle are integral to each other. In some embodiments, the handle 106 may include a detachable head housing. In some embodiments, the scalloped outer race 500 does not move relative to the handle 106. If the scalloped outer race 500 is a separate piece from the head housing and snaps into place within the housing, then the central axis of the scalloped outer race 500 aligns with the axis of the head housing so as to not move relative to the head housing. In the illustrated embodiment, the handle and the scalloped outer race are one integral piece.

In the illustrated embodiment, the backplate 110 inserts into the rear of the handle 106 and the reverse switch 102 is secured by the shoulder screw 112. The rollers 400 are positioned between the pillars of the roller cage bias ring 300 to form a cage assembly. The cage assembly is located within the scalloped outer race 500. The spindle 104 is located within the cage assembly. In some embodiments, the rollers 400 interface with the scalloped outer race 500 and the circular inner race 602 of the spindle 104. The rollers 400 are indexed by the roller cage bias ring 300 (shown and described more fully in FIGS. 6A-6D. In some embodiments, the roller cage bias ring 300 is configured to position the rollers 400 relative to the surface of the scalloped outer race 500. In some embodiments, the roller cage bias ring 300 is configured to index to two positions.

In some embodiments, the reverse lever 102 is configured to interface with the roller cage bias ring 300. In some embodiments, the reverse lever 102 includes a knob 118 (see FIG. 1E) that interfaces with a notch 310 (shown in FIG. 3B) in the roller cage bias ring 300. The reverse lever 102 is attached to the handle 106 by inserting protrusion 120 into an opening on the handle 106 and is secured by a shoulder screw 112. The reverse lever 102 can rotate about the protrusion 120 and thus rotate the relative position of the knob 118. As the knob 118 rotates, the roller cage bias ring 300 rotates between a first and second position, which will in turn locate the rollers 400 relative to sloped concave ramp surfaces of the scallops of the outer race 500. The illustrated embodiment further includes a quick release plunger 108 and associated spring that may be configured to release attachments to the male adapter of the spindle 104. The illustrated embodiment further includes a front cap 114 and snap ring 116 that will secure in place the cage assembly between the backplate 110 and the front cap 114.

Figure 2:
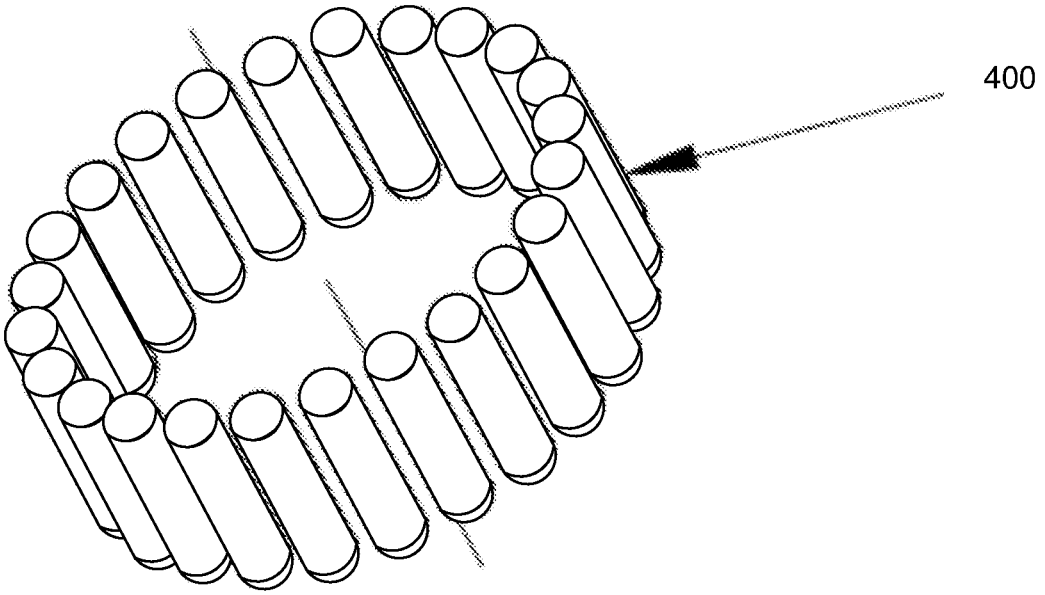
FIG. 2 depicts a perspective view of the rollers of the torque transfer device of FIGS. 1C and 1D.

FIG. 2 depicts a perspective view of a plurality of rollers of the torque transfer device of FIGS. 1C and 1D.

Figure 3A:
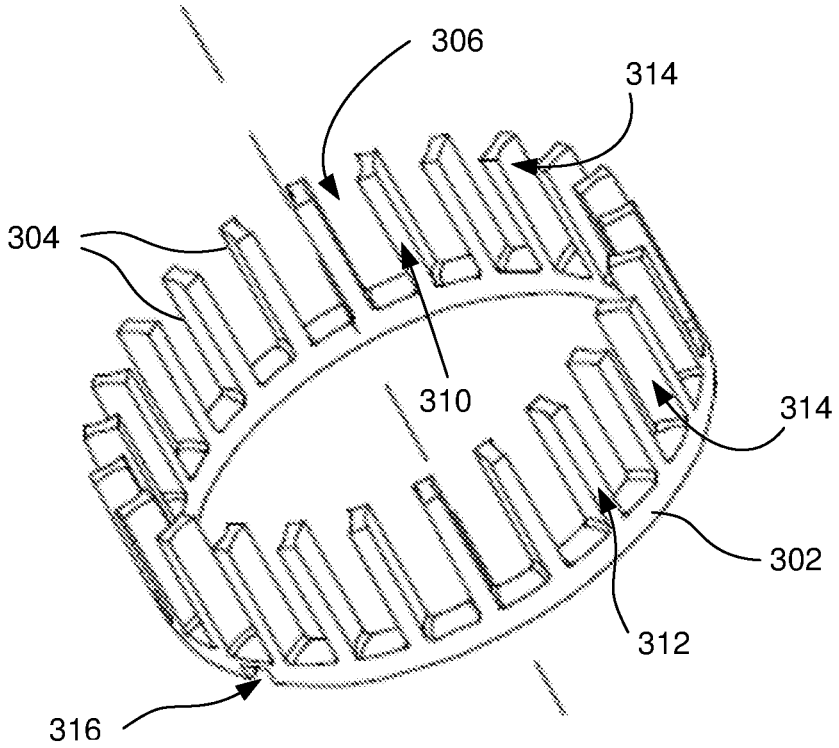
FIG. 3A depicts a perspective front view of the roller cage bias ring of FIGS. 1C and 1D.
Figure 3B:
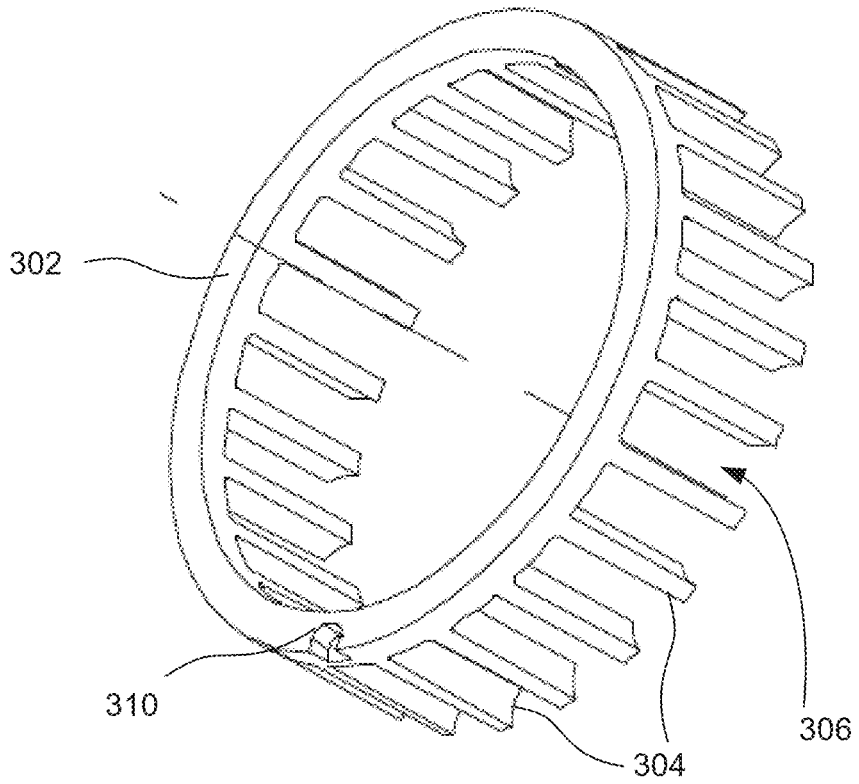
FIG. 3B depicts a perspective rear view of the roller cage bias ring of FIGS. 1C and 1D.

FIG. 3A depicts a perspective front view of the roller cage bias ring 300 of FIGS. 1C and 1D. FIG. 3B depicts a perspective rear view of the roller cage bias ring of FIGS. 1C and 1D. In the illustrated embodiment, the roller cage bias ring 300 includes a base ring 302 with a plurality of a pillars 304 extending out from the base ring 302. In the illustrated embodiment the 24 rollers of FIG. 2 would align and be inserted into the cavities 306 between the pillars 304 of the roller cage bias ring 300. In the illustrated embodiment, the pillars 304 include an inner surface 310, an outer surface 312, and side surfaces 314. In some embodiments, the side surfaces 314 of the pillars 304 are concave to provide radial stability of the rollers 400 within the cavities 306 between the pillars 304. The rollers 400 when inserted into the roller cage bias ring 300 will extend farther out and farther in than the outer surface 312 and the inner surface 310, respectively. This is depicted more clearly in FIGS. 3C, 6A-6D. The roller cage bias ring 300 also includes a notch 316. The notch 316 may interface with the reverse lever 102 to index the roller cage bias ring 300 as described herein.

Figure 3C:
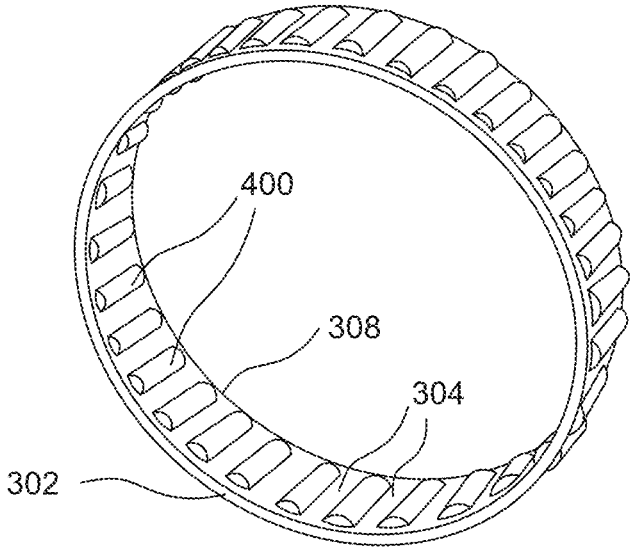
FIG. 3C depicts a perspective view of another embodiment of a roller cage bias ring and rollers.

FIG. 3C depicts a perspective view of another embodiment of a roller cage bias ring 300 and rollers 400. In the embodiment of FIGS. 3A and 3B the pillars 304 extend out of one base ring 302. In the embodiment of FIG. 3C the pillars 304 extend between a base ring 302 and a cap ring 308. Utilizing a base ring 302 and a cap ring 308, while more expensive to manufacture, provides more stability to the pillars 304 and may ensure greater precision in indexing the rollers 400 to the correct location.

Figure 4A:
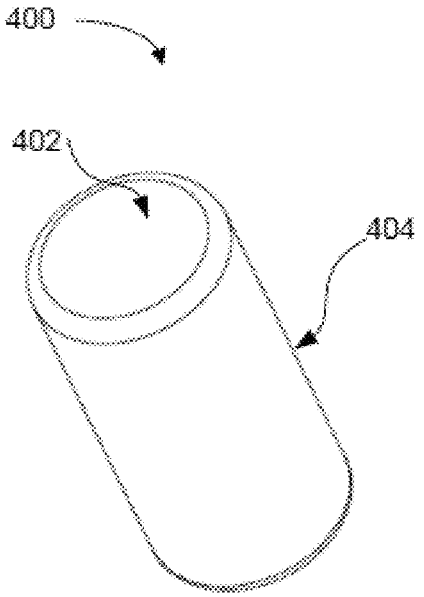
FIG. 4A depicts a perspective view of an embodiment of a roller.
Figure 4B:
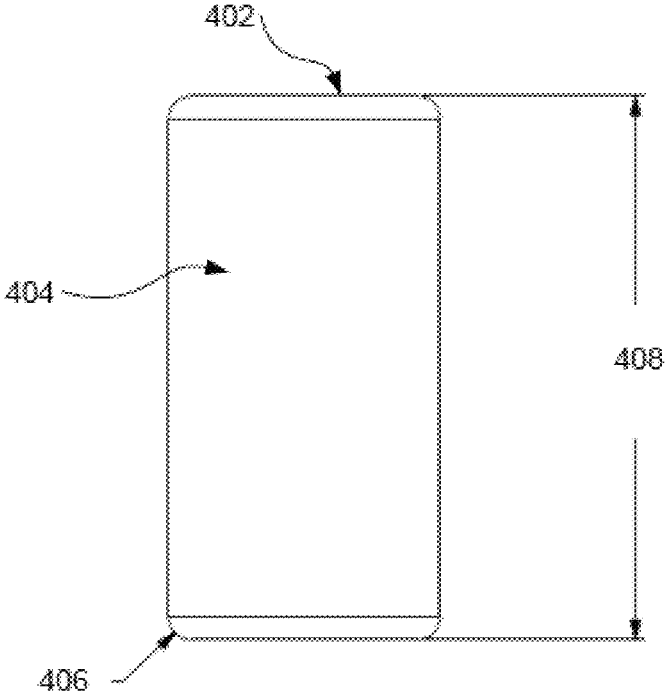
FIG. 4B depicts side view of the roller of FIG. 4A
Figure 4C:
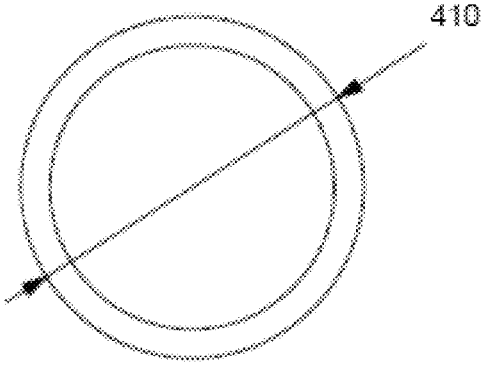
FIG. 4C depicts a top view of the roller of FIG. 4A.

FIG. 4A depicts a perspective view of an embodiment of a roller 400. FIG. 4B depicts side view of the roller 400 of FIG. 4A. FIG. 4C depicts a top view of the roller 400 of FIG. 4A. Although the roller 400 is shown and described with certain components and functionality, other embodiments of the roller 400 may include fewer or more components to implement less or more functionality.

The illustrated embodiment of the roller 400 is primarily cylindrical in shape. FIGS. 6A-6D show the top surface 402 of the rollers 400. In some embodiments, the rollers 400 are rounded 406 or chamfered on the edges of the primarily cylindrical shape. The rollers may be of various shapes such that they will wedge and compress between the inner race of the spindle 104 and the scalloped outer race 500 on a particular rotation of the spindle 104 and will freely allow movement in an opposite rotation. In some embodiments, the rollers include a height 408 approximately the size of the cavity between the front cap 114 and the backplate 110. The side surface 404 of the roller 400 contacts the ramp surface of the scallops and the inner race of the spindle 104 when the roller 400 is placed within the torque transfer device. In some embodiments, the roller 400 includes a diameter 410 optimized to fit within the cavity between the inner race of the spindle 104, the scalloped outer race 500, and the side surfaces 314 of the roller cage bias ring 300.

Figure 4D:
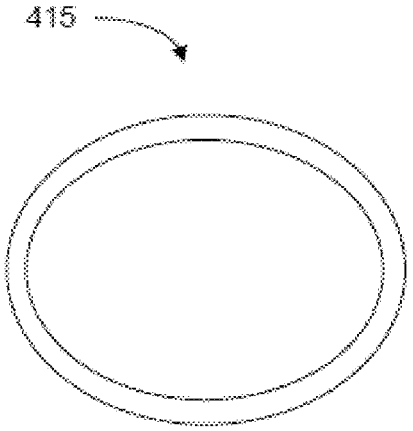
FIG. 4D depicts a top view of another embodiment of a roller in the shape of an elliptical cylinder.

The rollers 400 are not restricted to a circular cylinder as depicted in FIGS. 4A-4C. FIG. 4D depicts a top view of another embodiment of a roller in the shape of an elliptical cylinder 415. The roller may be manufactured to another shape to better conform to the concavity of the ramp surface. The roller may be (but is not limited to) a circular cylinder, an elliptical cylinder, a curvilinear cylinder, a polyhedral prism, a combination of a curvilinear cylinder and a polyhedral prism. The shape of the roller can be designed to increase the contact surface between the roller and the ramp surface as well as the contact surface between the roller and the inner race. For example, an elliptical cylinder may have an outer surface that more closely mates to the concave ramp surface.

Figure 5A:
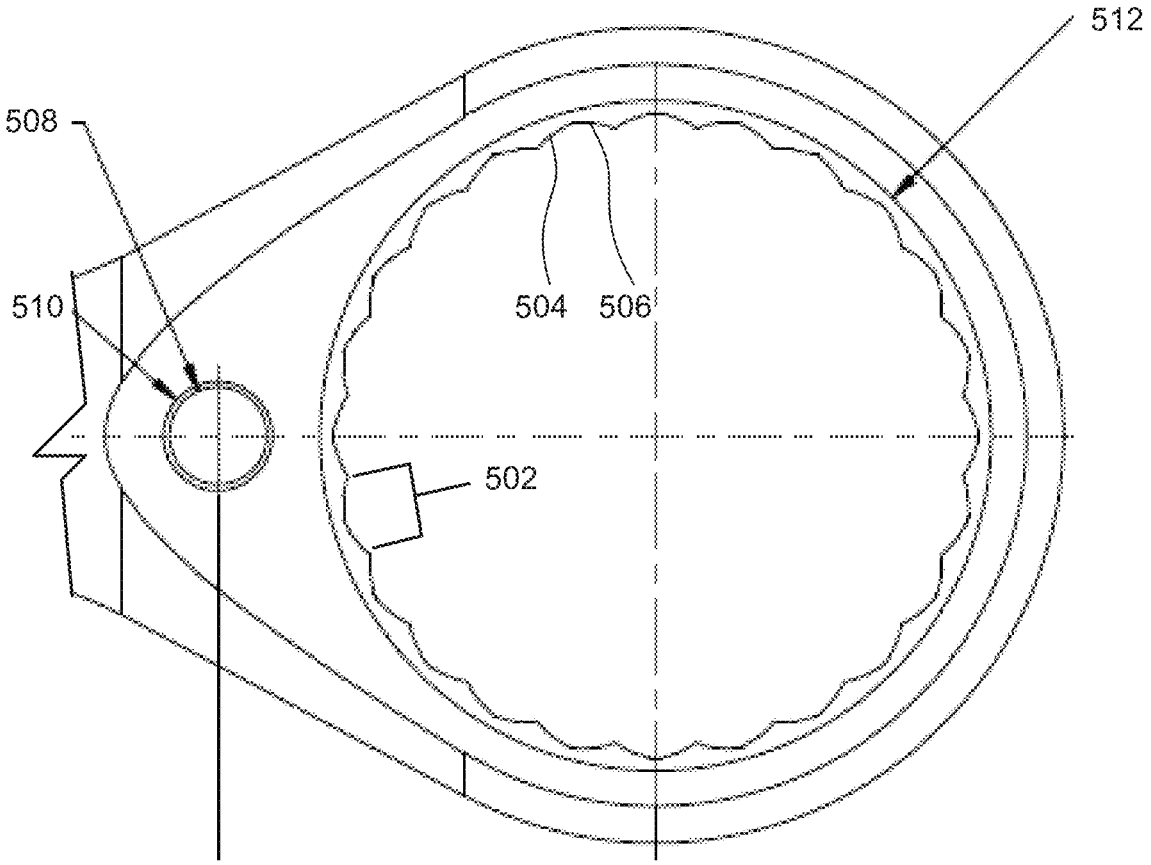
FIG. 5A depicts a rear view of an embodiment of the head portion of a handle including a scalloped outer race.

FIG. 5A depicts a rear view of an embodiment of the head portion of a handle 106 including a scalloped outer race. Although the handle 106 is shown and described with certain components and functionality, other embodiments of the handle 106 may include fewer or more components to implement less or more functionality.

The illustrated embodiment depicts twenty four scallops 502 on the outer race. Each individual scallop 502 includes two opposing sloped concave ramp surfaces, a first sloped ramp surface 504 and a second sloped ramp surface 506. The rollers 400 are indexed by the roller cage bias ring 300 to one of the sloped concave ramp surfaces. Also depicted is the mating cavity 508 for the reverse lever 102 and shoulder screw 112. And the landing surface 512 for the front cap 114.

Figure 5B:
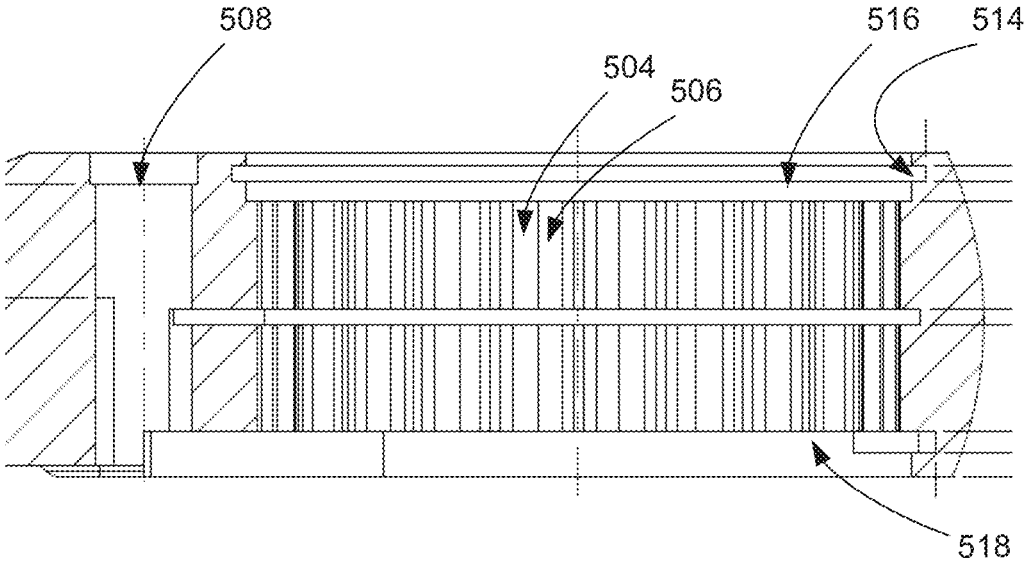
FIG. 5B depicts side cut-away view of the head portion of the handle of FIG. 4A.

FIG. 5B depicts side cut-away view of the head portion of the handle of FIG. 4A and depicts the first sloped ramp surface 504, the second sloped ramp surface 506, the mating cavity 508, the snap ring cavity 514, the front cap cavity 516, and the backplate cavity 518. In some embodiments, the sloped ramp surfaces are concave.

Figure 6A:
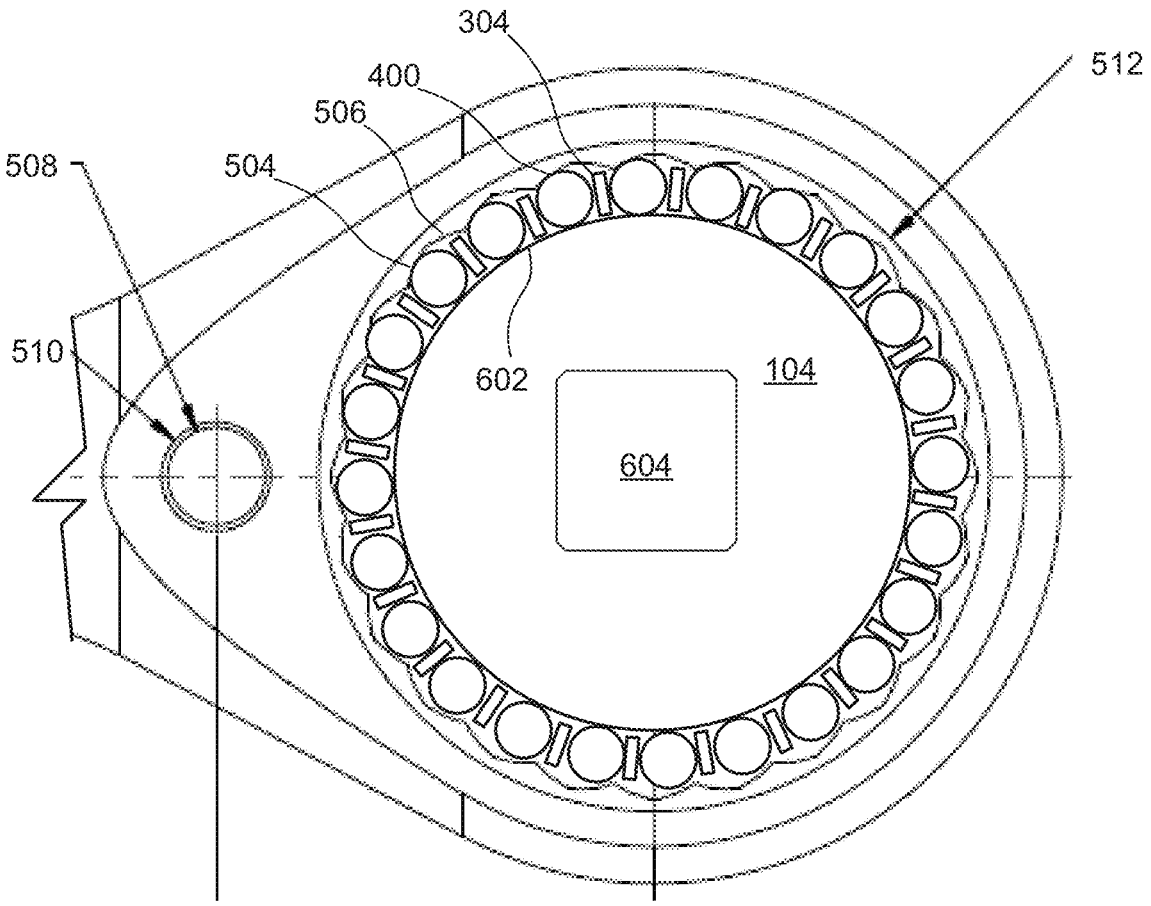
FIG. 6A depicts a front view of an embodiment of a scalloped outer race, rollers, roller cage bias ring, and spindle in a first torqued position.

FIG. 6A depicts a front view of an embodiment of a scalloped outer race including twenty four scallops, rollers 400, the pillars 304 of the roller cage bias ring 300, and spindle 104 in a first torqued position. The illustrated embodiment depicts the roller cage bias ring 300 indexing the rollers 400 to a first side of the scallops 502. The roller cage bias ring 300 indexes the rollers 400 to a position between the inner race 602 of the spindle 104 and a first sloped concave ramp surface 504. In the illustrated embodiment, the first sloped concave ramp surface 504 of each scallop 502 slope toward the inner race 602 when going in a counter clockwise direction along the ramp surface and slope away from the inner race 602 when going in a clockwise direction along the ramp surface. When the rollers 400 are indexed in this first position, the spindle 104 is restricted from moving counter clockwise relative to the handle 106. That is, a force acting on the spindle 104 to rotate counter clockwise relative to the handle 106 will result in the rollers 400 wedging between the inner race 602 and the first sloped ramp surface 504. The spindle 104 will freely rotate in a clockwise direction relative to the handle 106 as the rollers 400 will not wedge when the spindle 104 is rotated clockwise.

Figure 6B:
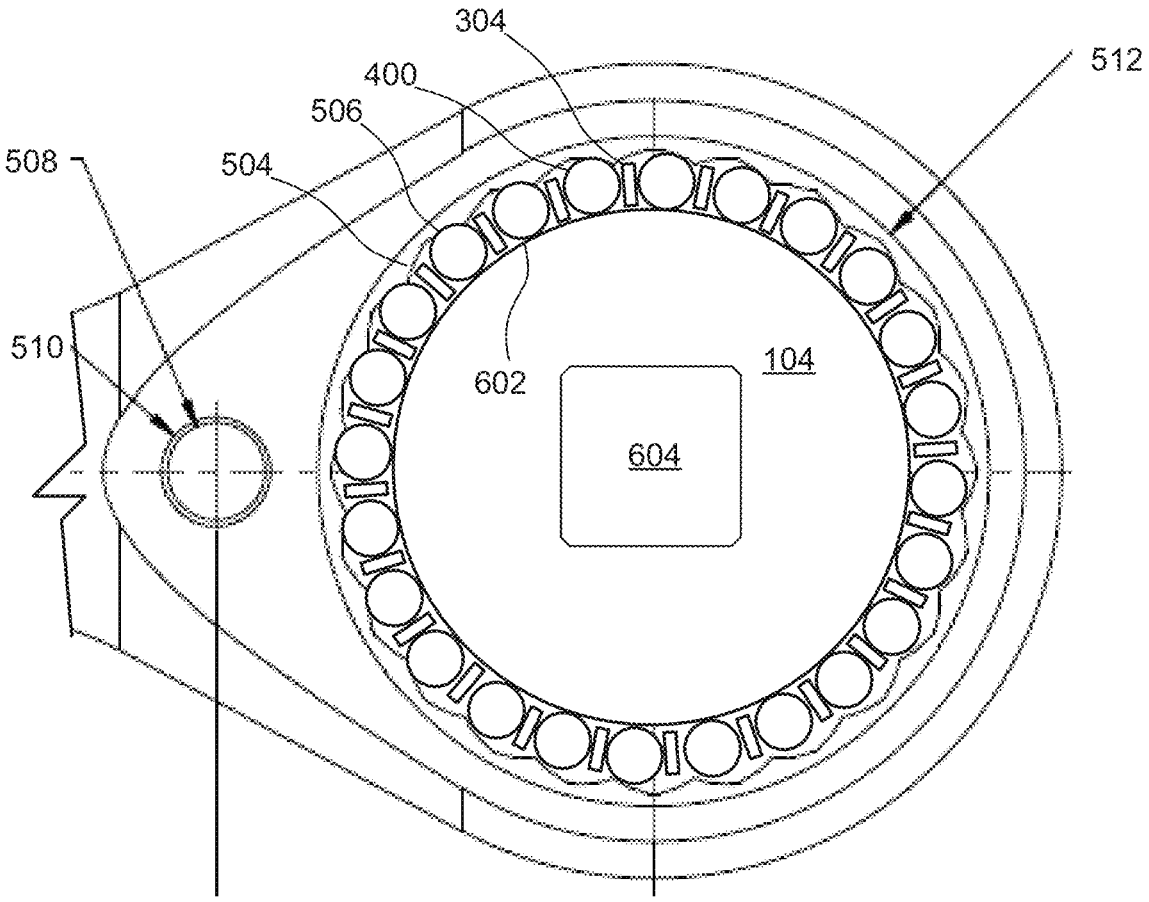
FIG. 6B depicts a front view of an embodiment of a scalloped outer race, rollers, roller cage bias ring, and spindle in a second torqued position.

FIG. 6B depicts a front view of an embodiment of a scalloped outer race including twenty four scallops, rollers 400, the pillars 304 of the roller cage bias ring 300, and spindle 104 in a second torqued position. The illustrated embodiment depicts the roller cage bias ring 300 indexing the rollers 400 to a second side of the scallops 502. The roller cage bias ring 300 indexes the rollers 400 to a position between the inner race 602 of the spindle 104 and the second sloped concave ramp surface 506. In the illustrated embodiment, the second sloped concave ramp surface 506 of each scallop 502 slope toward the inner race 602 when going in a clockwise direction along the ramp surface and slope away from the inner race 602 when going in a counter clockwise direction along the ramp surface. When the rollers 400 are indexed in this second position, the spindle 104 is restricted from moving clockwise relative to the handle 106. That is, a force acting on the spindle 104 to rotate clockwise relative to the handle 106 will result in the rollers 400 wedging between the inner race 602 and the second sloped ramp surface 506. The spindle 104 will freely rotate in a counter clockwise direction relative to the handle 106 as the rollers 400 will not wedge when the spindle 104 is rotated counter clockwise. The roller cage bias ring 300 allows the torque transfer device to index all the rollers 400 to the appropriate ramp surface. The roller cage bias ring 300 restricts the rollers from slipping or rolling to the opposite ramp surface. All rollers 400 are indexed and stay on the appropriate ramp surface.

Figure 6C:
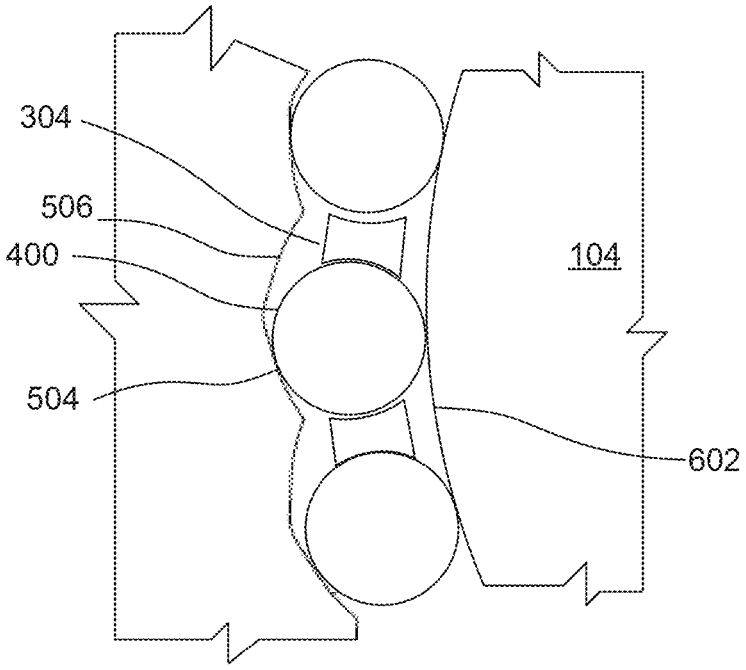
FIG. 6C depicts a close-up view of the roller in a first position and FIG. 6D depicts a close-up view of the roller in a second position.
Figure 6D:
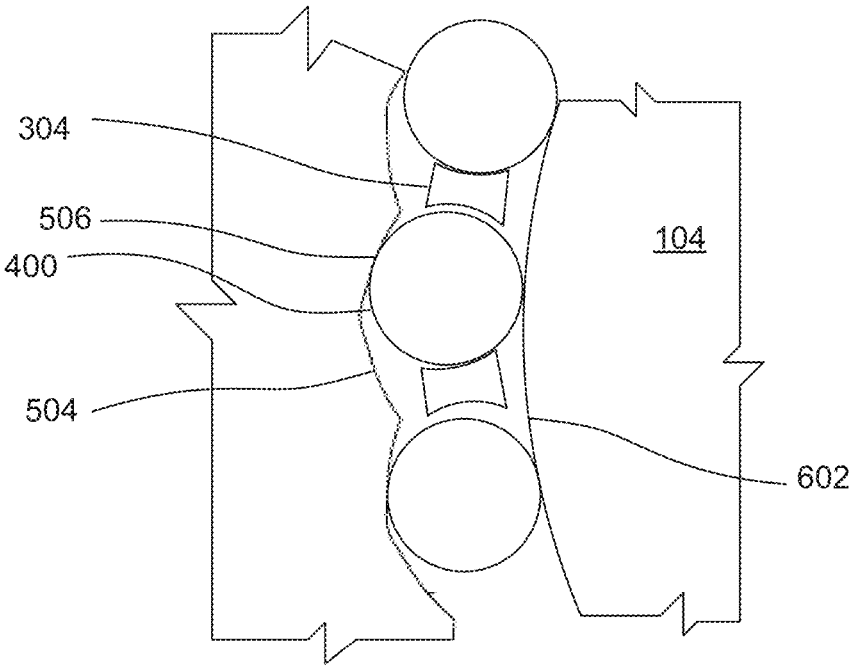

FIG. 6C depicts a close-up view of the roller 400 in a first position and FIG. 6D depicts a close-up view of the roller 400 in a second position. In FIG. 6C, the spindle 104 is restricted from rotating counter clockwise relative to the scalloped outer race. In FIG. 6D, the spindle 104 is restricted from rotating clockwise relative to the scalloped outer race. The scallop 502 includes a first 504 and second sloped ramp surface 506. In the illustrated embodiment, the ramp surfaces 504, 506 are concave. In the illustrated embodiment, each ramp surface 504, 506 includes two concave portions with a flat portion in between the concave portions. The ramp surfaces may be designed to optimize the contact surface between the outer surface 404 of the rollers and the ramp surface of the scallops so as to eliminate or greatly reduce brinneling or other wear. The sloped ramp surfaces 504, 506 may be flat, concave, or a combination of both.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

Although various embodiments have been shown and described, the present disclosure is not so limited and will be understood to include all such modifications and variations are would be apparent to one skilled in the art.

What is claimed is:

1. A torque transfer device comprising:

a handle comprising a scalloped outer race;

a roller cage bias ring located within the scalloped outer race, wherein the roller cage bias ring comprises a base ring and a plurality of pillars extending out of the base ring, wherein the base ring is an annular ring, wherein each pillar is connected to the base ring at a first end, wherein the second end is opposite the first end, wherein the roller cage bias ring comprises a notch;

a plurality of rollers, wherein each roller is movably positioned between two pillars, and wherein each pillar is configured to physically engage two adjacent rollers alternatively but not at the same time;

a spindle comprising an inner race;

a backplate configured to couple to the handle and cover the roller cage bias ring, wherein the backplate comprises a recessed circular trench and an aperture, wherein the recessed circular trench concentrically aligns with the roller cage bias ring;

wherein the bias ring is configured to move within a space between the inner race of the spindle and the outer race of the handle, said movement causing at least one pillar to movably engage a respective roller to facilitate the frictional engagement of the respective roller with both the inner race and the outer race; and a reverse lever movably coupled to the handle, wherein the reverse lever comprises a knob configured to extend through the aperture of the backplate and interface with the notch of the roller cage bias ring, and further comprising a spring disposed within a hole in the handle, wherein the spring is configured to apply a retention force against the reverse lever to prevent movement of the knob.

2. The torque transfer device of claim 1, wherein each scallop of the scalloped outer race comprises two opposing sloped concave ramp surfaces, comprising a first sloped concave ramp surface and a second sloped concave ramp surface.

3. The torque transfer device of claim 2, wherein the roller cage bias ring is configured to rotate between two fixed positions relative to the scalloped outer race, wherein a first fixed position of the roller cage bias ring is configured to position at least one roller against the first sloped concave ramp surface and wherein a second fixed position of the roller cage bias ring is configured to position at least one roller against the second sloped concave ramp surface.

4. The torque transfer device of claim 3, wherein in the first fixed position the rollers compress between the first sloped ramp surface and the inner race and resist rotation of the spindle relative to the handle in one of a clockwise or counter-clockwise rotation.

5. The torque transfer device of claim 4, wherein in the second fixed position at least one roller compresses between the second sloped ramp surface and the inner race to resist rotation of the spindle relative to the handle in an opposite direction to the one of the clockwise or counter-clockwise rotation.

6. The torque transfer device of claim 1, wherein each roller comprises an orthogonal cross section that is one of circular, elliptical, or curvilinear.

7. The torque transfer device of claim 1, wherein each scallop of the scalloped outer race comprises at least one ramp surface.

8. The torque transfer device of claim 1, further comprising a reverse lever, wherein the reverse lever is configured to interface with the roller cage bias ring.

9. The torque transfer device of claim 1, wherein the spindle comprises a smooth circular inner race.

10. A torque transfer device comprising:

a handle;

an outer race attached to the handle, the outer race comprising an inner surface;

a spindle comprising an inner race, the inner race comprising an outer surface;

a plurality of rollers;

a roller cage bias ring located within a space defined by the inner surface of the outer race and the outer surface of the inner race, wherein the roller cage bias ring comprises a base ring and a plurality of pillars extending out of the base ring, wherein the base ring is an annular ring, wherein each pillar is connected to the base ring at a first end, wherein the second end is opposite the first end, and wherein each roller is movably positioned between adjacent pillars, wherein each pillar is configured to physically engage two adjacent rollers alternately but not at the same time;

wherein the inner surface of the outer race is scalloped and does not move relative to the handle, each roller being movably positioned within a corresponding scallop, and wherein each pillar is configured to simultaneously urge a corresponding roller distinct from every other roller into a position on the scalloped outer race;

a backplate configured to couple to the handle and cover the roller cage bias ring, wherein the backplate comprises a recessed circular trench and an aperture, wherein the recessed circular trench concentrically aligns with the roller cage bias ring;

wherein the bias ring is configured to move within a space between the inner race of the spindle and the outer race of the handle, said movement causing at least one pillar to movably engage a respective roller to facilitate the frictional engagement of the respective roller with both the inner race and the outer race; and a reverse lever movably coupled to the handle, wherein the reverse lever is configured to extend through the aperture of the backplate and mechanically interface with the roller cage bias ring, and further comprising a spring disposed within a hole in the handle, wherein the spring is configured to apply a retention force against the reverse lever to prevent movement of the knob.

11. The torque transfer device of claim 10, wherein each scallop of the scalloped outer race comprises two opposing sloped concave ramp surfaces, comprising a first sloped concave ramp surface and a second sloped concave ramp surface.

12. The torque transfer device of claim 11, wherein the roller cage bias ring is configured to rotate between two fixed positions relative to the scalloped outer race, wherein a first fixed position of the roller cage bias ring is configured to position at least one roller against the first sloped concave ramp surface and wherein a second fixed position of the roller cage bias ring is configured to position at least one roller against the second sloped concave ramp surface.

13. The torque transfer device of claim 12, wherein in the first fixed position at least one roller compresses between the first sloped ramp surface and the inner race and resists rotation of the spindle relative to the handle in one of a clockwise or counter-clockwise rotation.

14. The torque transfer device of claim 13, wherein in the second fixed position at least one roller compresses between the second sloped ramp surface and the inner race and resist rotation of the spindle relative to the handle in an opposite direction to the one of the clockwise or counter-clockwise rotation.

15. The torque transfer device of claim 10, wherein each roller comprises an orthogonal cross section that is one of circular, elliptical, or curvilinear.

16. The torque transfer device of claim 10, wherein each scallop of the scalloped outer race comprises two opposing sloped ramp surfaces, comprising a first sloped ramp surface and a second sloped ramp surface, wherein the first and second sloped ramp surfaces are one of flat, concave, or a combination of flat and concave.

17. The torque transfer device of claim 10, further comprising a reverse lever, wherein the reverse lever is configured to interface with the roller cage bias ring, and wherein the reverse lever is located outside the scalloped outer race.

18. A torque transfer device comprising:

a handle;

an outer race attached to the handle, the outer race comprising an inner surface, the inner surface comprising a plurality of scallops;

a spindle comprising an inner race, the inner race comprising an outer surface;

a plurality of rollers;

a roller cage bias ring positioned within a space defined by the inner surface of the outer race and the outer surface of the inner race, wherein the roller cage bias ring comprises a base ring and a plurality of pillars extending out of the base ring such that each pillar is connected to the base ring at a first end, wherein each roller is movably positioned between adjacent pillars, and wherein each roller is positioned adjacent one scallop, and wherein each pillar is configured to alternatively physically engage two adjacent rollers but not at the same time;

a backplate configured to couple to the handle and cover the roller cage bias ring, wherein the backplate comprises a recessed circular trench and an aperture, wherein the recessed circular trench concentrically aligns with the roller cage bias ring; and a reverse lever, wherein the reverse lever is operably engaged with the roller cage bias ring through the aperture of the backplate such that movement of the reverse lever causes the at least one pillar to movably engage a first roller to facilitate the frictional engagement of the first roller with the inner race and the outer race in a first position of the reverse lever and said movement of the reverse lever causing the at least one pillar to movably engage a roller adjacent the first roller to facilitate the frictional engagement of the adjacent roller with the inner race and the outer race in a second position of the reverse lever.

19. The torque transfer device of claim 18, wherein the frictional engagement of the at least one roller with both the inner race and the outer race prevents rotational movement of the spindle in a first rotational direction relative to the handle.

20. The torque transfer device of claim 18, wherein the frictional engagement of the at least one roller with both the inner race and the outer race allows rotational movement of the spindle in a second rotational direction opposite the first rotational direction.

21. The torque transfer device of claim 18, wherein the roller cage bias ring is configured and positioned within the space between the inner surfaced of the outer race and the outer surface of the inner race such that movement of the roller cage bias ring causes a plurality of pillars to simultaneously engage a corresponding plurality of rollers.

22. The torque transfer device of claim 18, wherein the reverse lever is movably coupled to the handle, and wherein the reverse lever comprises:

a protrusion disposed within a corresponding opening on the handle, wherein the opening is located outside of the scalloped outer race; and a knob coupled to and extending from a distal end of the reverse, through said aperture in the backplate, lever to engage into a corresponding notch in the base ring of the roller cage bias ring, wherein the knob is configured to shift the roller cage bias ring into one of the first and second positions in response to manipulation of the reverse lever by a user.

23. The torque transfer device of claim 22, wherein the reverse lever further comprises:

a second protrusion coupled to and extending from a bottom surface of the reverse lever; and a spring disposed within a hole in the handle, wherein the spring is configured to apply a retention force against the second protrusion to prevent movement of the knob and to maintain the roller cage bias ring in one of first and second positions.

24. The torque transfer device of claim 22, wherein the first position:

prevents rotation of the spindle in a clockwise rotational direction within the head; and allows rotation of the spindle in a counterclockwise rotational direction within the head.

25. The torque transfer device of claim 22, wherein the second position:

prevents rotation of the spindle in a counterclockwise rotational direction within the head; and allows rotation of the spindle in a clockwise rotational direction within the head.

* * * * *